US008561688B2

(12) United States Patent
Evans

(10) Patent No.: US 8,561,688 B2
(45) Date of Patent: Oct. 22, 2013

(54) COMPACT JAR FOR DISLODGING TOOLS IN AN OIL OR GAS WELL

(75) Inventor: Robert W. Evans, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/567,717

(22) Filed: Aug. 6, 2012

(65) Prior Publication Data

US 2012/0298365 A1 Nov. 29, 2012

Related U.S. Application Data

(63) Continuation of application No. 12/575,811, filed on Oct. 8, 2009, now Pat. No. 8,256,509.

(51) Int. Cl.
*E21B 31/107* (2006.01)
*E21B 17/07* (2006.01)

(52) U.S. Cl.
USPC ..... 166/178; 166/301

(58) Field of Classification Search
USPC ..... 166/178, 301
See application file for complete search history.

(56) References Cited

U.S. PATENT DOCUMENTS

| | | | | |
|---|---|---|---|---|
| 4,646,830 | A | 3/1987 | Templeton | |
| 5,232,060 | A | 8/1993 | Evans | |
| 6,290,004 | B1 * | 9/2001 | Evans | 175/296 |
| 6,386,545 | B1 | 5/2002 | Evans | |
| 6,481,495 | B1 | 11/2002 | Evans | |
| 6,988,551 | B2 | 1/2006 | Evans | |
| 7,290,604 | B2 | 11/2007 | Evans | |
| 7,311,149 | B2 | 12/2007 | Evans | |
| 7,510,008 | B2 * | 3/2009 | Evans | 166/301 |
| 7,854,425 | B2 | 12/2010 | Evans | |
| 8,256,509 | B2 | 9/2012 | Evans | |
| 2005/0092484 | A1 | 5/2005 | Evans | |
| 2005/0092495 | A1 | 5/2005 | Evans | |
| 2006/0169456 | A1 | 8/2006 | Evans | |
| 2009/0020287 | A1 | 1/2009 | Evans | |
| 2010/0319930 | A1 * | 12/2010 | Evans | 166/377 |

OTHER PUBLICATIONS

PCT/US2010/051904 International Search Report and Written Opinion Dated May 9, 2011 (8 p.).

* cited by examiner

*Primary Examiner* — Kenneth L Thompson
*Assistant Examiner* — Catherine Loikith
(74) *Attorney, Agent, or Firm* — Conley Rose, P.C.

(57) ABSTRACT

This invention relates to a jar used to dislodge tools stuck in a well. The jar includes two housing portions movable with respect to each other. A release collet forms a portion of one of the housings. A release sleeve is carried by a mandrel and is located within the release collet. After a given amount of movement of the housing with respect to the mandrel, the release mechanism is activated and the two housing sections rapidly move with respect to each other. A hammer portion of the mandrel then strikes an anvil in the anvil housing, thus applying an upward force to the tool lodged in the well.

19 Claims, 2 Drawing Sheets

COMPACT JAR FOR DISLODGING TOOLS IN AN OIL OR GAS WELL

BACKGROUND OF INVENTION

1. Field of the Invention

This invention is directed to a tool for exerting an upward force on another tool that may have become stuck in an oil or gas well. Such tools are commonly referred to as "jars." Typically jars include a connecting device that is released at a certain level of force being applied to the line to cause a hammer to strike an anvil surface within the tool. The present invention is directed to an improvement in such a device 2. Description of Related Art The sticking of drilling or production equipment in an oil or gas well bore may be eliminated by delivering an upward axial blow to unstick the equipment. Downhole tools known as "jars" have been used in such situations. One type of jar is a "drilling jar." Another type of jar is a "wireline jar." In the case of a wireline jar, a series of impact blows is delivered to the stuck equipment by manipulation of the wireline. Wireline jars typically have an inner mandrel and an outer housing telescopically coupled together for relative axial, sliding movement. The mandrel carries a hammer and the housing carries an anvil. By directing the hammer to impact the anvil at high velocity, a substantial jarring force may be imparted to the stuck equipment, which is often sufficient to jar the stuck equipment free.

Examples of prior art jars are described in U.S. Pat. Nos. 6,988,551; 7,290,604; and 7,311,149.

BRIEF SUMMARY OF THE INVENTION

The present invention is directed to an improved release mechanism in a jar. The mechanism is extremely reliable and effective in delivering an upward jarring force on the stuck tool below it. This is achieved by forming a portion of the release collet as part of the housing and having the release sleeve carried by a mandrel that slides within the release collet. The resulting structure is compact and efficient.

BRIEF DESCRIPTION OF THE SEVERAL VIEWS OF THE DRAWING(S)

DETAILED DESCRIPTION OF THE INVENTION

Figure 1A:
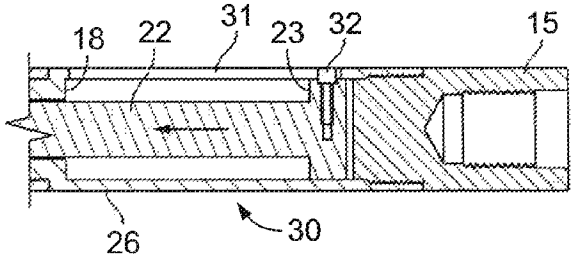
FIGS. 1A and 1B are sectional longitudinal views of the jar with no load applied.
Figure 1B:
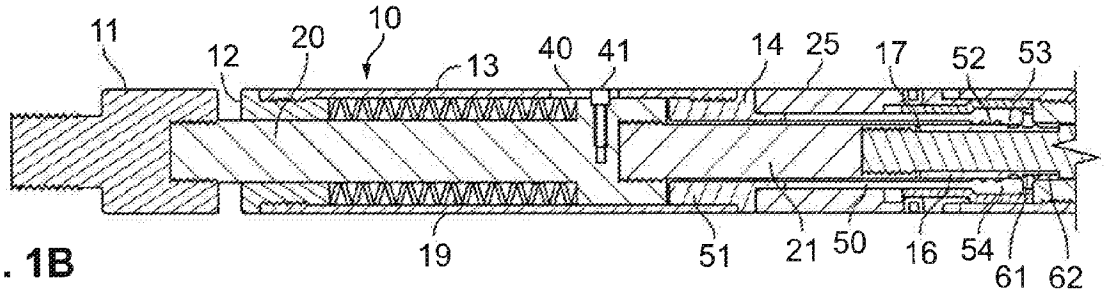
Figure 2B:
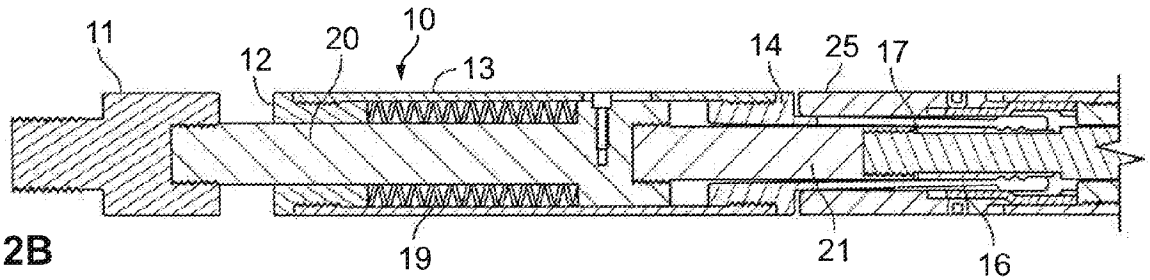

The invention will now be described in conjunction with reference to the drawings. The term proximal when used refers to that portion of the part being referred to that is closest to the wellhead, and the term distal refers to the portion of the part that is furthest from the wellhead. As shown in FIG. 1B, the jar includes a mandrel connection pin 11 for attachment to the wireline. Connected within an internal bore in the mandrel connection pin 11 is the main mandrel portion 20 having an enlarged portion at the distal end thereof for receiving an externally threaded portion of collet mandrel 21. Collet mandrel 21 has a distal internally threaded bore to which is threaded hammer mandrel 22. As described, the mandrel of the jar includes main mandrel portion 20, collet mandrel 21 and hammer mandrel 22. Hammer mandrel 22 has an enlarged hammer surface 23 as shown FIG. 1A. A cylindrical housing member 10 surrounds the mandrel assembly and includes spring housing 13 with slot 40, proximal seal housing 12 and release collet 14. A pin 41 is located within slot 40 and is threadedly secured to main mandrel portion 20 as shown in FIG. 1B. Seal housing 12 is threadedly secured to the proximal portion of spring housing 13 and release collet 14 is threadedly secured to spring housing 13 at its distal portion as shown in FIG. 1B.

Figure 2A:
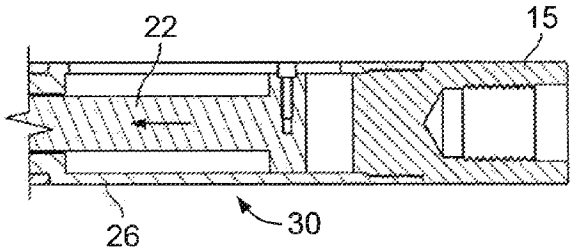
FIGS. 2A and 2B are longitudinal views of the jar as the jar is activated.
Figure 3A:
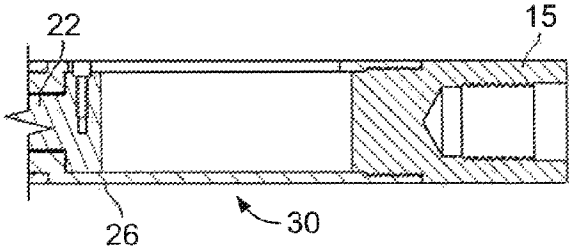
FIGS. 3A and 3B are sectional views of the device after the device has been actuated.
Figure 3B:
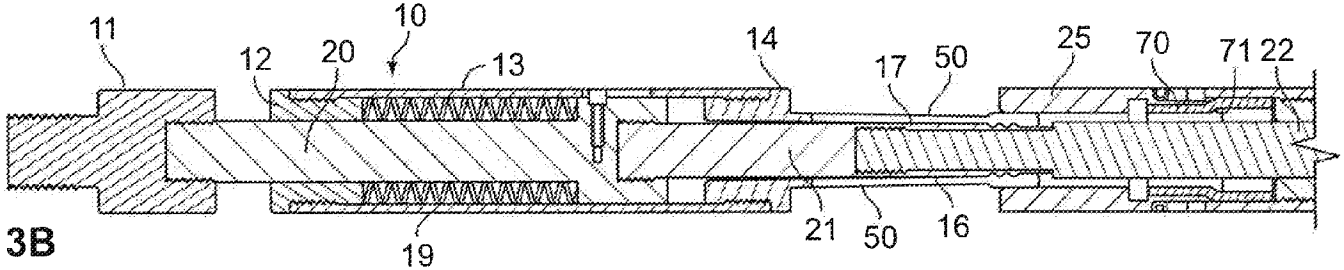

A second cylindrical housing member 30 surrounds the distal portion of the mandrel and is longitudinally movable with respect to the mandrel as shown in FIG. 3A. The second housing has a collet housing 25 (FIG. 3B), which has an internally thread bore section at its distal end that receives hammer housing 26. Located within the hammer housing is an anvil shoulder 18 at the proximal portion of the hammer housing. Hammer housing 26 is internally threaded at its distal end to receive a tool connection housing 15, which is adapted to be threadedly connected to a downhole tool, not shown. The hammer housing also includes a longitudinal slot 31 thru which a pin 32 is received. The pin is fixed to an enlarged portion of the hammer mandrel at its distal end as shown in FIG. 2A.

A spring device 19, which may be a series of bellville washers, is located between the spring housing 13 and main mandrel portion 20. At its proximal end spring 19 abuts against a shoulder formed on the distal end of seal housing 12 and at its distal end abuts a shoulder formed on main mandrel 20. Release collet 14 has a plurality of flexible finger members 50 extending from a main body section 51 as shown in FIG. 1B. Each finger has a plurality of tabs 52 extending radially inwardly of the same width and an end tab 53 of greater thickness than tabs 52 as seen in FIG. 1B. A collet release sleeve 16 is mounted on the proximal end of hammer mandrel 22. A spring washer 17 is positioned on the proximal end of hammer mandrel between the proximal portion of the collet release sleeve 16 and the distal end face of collet mandrel 21. The collet release sleeve 16 has a plurality of grooves 61 that are adapted to receive the tabs 52 of the finger members when the mandrel moves a given distance within the release collet 14. Release sleeve 16 also has an enlarged groove 62 on its distal end to receive end tab 53 on each of the flexible fingers 50 of the release collet. Fingers 50 also have a slightly angled abutment surface 54 located on their outer surface at the enlarged portion of the fingers 50 as shown in FIG. 1B.

The side walls of the tabs 52, 53 and the side walls of the grooves 61, 62 are slightly inclined as shown in FIG. 1B to allow for sliding movement with respect to each other.

Located between the release collet fingers and the collet housing 25 is an annular wear sleeve 70.

In operation, a tensile force applied to the mandrel connection will cause the mandrel to extend (right to left looking at FIG. 1), which in turn will cause spring 19 to compress. Release sleeve 16 moves with the collet mandrel 21 and eventually moves to a position where the tabs on the flexible fingers of the release collet 14 register with the grooves on the release sleeve 16 so that the fingers flex inwardly due to the forces at abutment surfaces 54 and abutment surface 71. The abutment shoulders 54 on the fingers are no longer engaged with the abutment surface 71 on the wear sleeve 70. At this point release collet 14 engages the mandrel via release sleeve 16. The tensile force on the wire pulls the mandrel up. The second housing and the tool attached to it are rapidly released from the first housing and hammer mandrel surface 23 is pulled up by the tension on the wireline until it strikes anvil 18, thereby exerting an upward force on the tool lodged in the well.

Although the present invention has been described with respect to specific details, it is not intended that such details should be regarded as limitations on the scope of the invention, except to the extent that they are included in the accompanying claims.

I claim:

1. A jar having a longitudinal axis, the jar comprising:

a first housing member including a release collet comprising a plurality of circumferentially spaced finger members, each finger member having a radially inner surface comprising a plurality of axially spaced tabs;

a second housing member coupled to the first housing member;

a mandrel extending through the first housing member and into the second housing member, wherein the mandrel has a hammer surface configured to impact an anvil surface in the second housing member; and a collet sleeve mounted to the mandrel and radially positioned between the mandrel and the finger members, wherein the collet sleeve has a radially outer surface comprising a plurality of axially spaced grooves configured to releasably engage the tabs;

wherein each finger member has a first position with the tabs radially withdrawn from the grooves and a second position with the tabs radially advanced into the grooves;

wherein the second housing member is configured to move axially relative to the first housing member in response to the finger members transitioning from the first position to the second position.

2. The jar of claim 1, wherein the first housing member includes a spring housing fixably coupled to the release collet.

3. The jar of claim 2, wherein the release collet further comprises a main body threadably coupled to the spring housing;

wherein each finger member has a fixed end secured to the main body and a free end distal the fixed end;

wherein the free ends of the finger members are configured to flex radially inward to transition the finger members from the second position to the first position, and flex radially outward to transition the finger members from the first position to the second position.

4. The jar of claim 2, wherein a biasing member is disposed within the spring housing and axially positioned between an inner shoulder of the first housing member and an outer shoulder of the mandrel.

5. The jar of claim 4, wherein the biasing member is configured to bias the hammer surface axially away from the anvil surface.

6. The jar of claim 1, further comprising a wear sleeve disposed within the second housing member, wherein the wear sleeve has a radially inner abutment surface that slidingly engages an angled abutment surface on each finger member.

7. The jar of claim 6, wherein the abutment surface of the wear sleeve is configured to urge the finger members radially inward to transition the finger members from the second position to the first position.

8. The jar of claim 1, wherein the first housing member includes a first longitudinal slot and the second housing member includes a second longitudinal slot, wherein the first longitudinal slot receives a first pin extending radially outward from the mandrel and the second longitudinal slot receives a second pin extending radially outward from the mandrel.

9. A jar having a longitudinal axis, the jar comprising:

a first housing member including a spring housing and a release collet fixably secured to the spring housing, wherein the release collet comprises plurality of circumferentially spaced finger members, each finger member having a radially inner surface comprising a plurality of axially spaced tabs;

a second housing member coupled to the first housing member;

a mandrel disposed within the first housing member and the second housing member, wherein the mandrel has a hammer surface configured to impact an anvil surface in the second housing member;

a biasing member disposed within the spring housing and axially positioned between an inner shoulder of the first housing member and an outer shoulder of the mandrel, wherein the biasing member is configured to bias the hammer surface axially away from the anvil surface; and a collet release sleeve radially positioned between the release collet and the mandrel;

wherein the tabs of the finger members of the release collet are configured to releasably engage a plurality of axially spaced grooves of the collet release sleeve;

wherein the release collet is axially fixed to the first housing in both a first position with the tabs radially withdrawn from the grooves and a second position with the tabs radially advanced into the grooves.

10. The jar of claim 9, wherein the release collet threadably engages the spring housing.

11. The jar of claim 9, wherein the release collet includes a plurality of circumferentially-spaced finger members, each finger member having a radially inner surface including a plurality of axially spaced tabs;

wherein the collet release sleeve has a radially outer surface including a plurality of grooves configured to releasably engage the tabs.

12. The jar of claim 11, wherein the finger members are configured to flex radially inward to engage the tabs with the grooves and flex radially outward to disengage the tabs from the grooves.

13. The jar of claim 11, wherein the second housing member is configured to move axially relative to the first housing member when the tabs disengage the grooves.

14. A method for actuating a jar having a longitudinal axis and including a first housing member, a second housing member coupled to the first housing member, and a mandrel extending axially through the first housing member into the second housing member, the method comprising:

(a) applying a tensile load to the jar to pull the mandrel in a first axial direction relative to the first housing member and the second housing member;

(b) preventing the first housing member from moving axially in the first direction relative to the second housing member during (a) by engaging an abutment surface on an outer surface of a release collet of the first housing member with an abutment surface on an inner surface of the second housing member;

(c) disengaging the abutment surface of the release collet and the abutment surface of the second housing member after (b); and (d) moving the first housing member with the mandrel axially in the first direction relative to the second housing member in response to (c).

15. The method of claim 14, further comprising exerting a biasing force on the mandrel in a second axial direction opposite the first axial direction during (b).

16. The method of claim 15, wherein exerting the biasing force comprises axially compressing a biasing member disposed within the first housing member between an inner shoulder of the first housing member and an outer shoulder of the mandrel.

17. The method of claim 14, wherein the release collet comprises a plurality of axially extending finger members, each finger member having a radially inner surface comprising a plurality of axially spaced tabs;

wherein (c) further comprises engaging the tabs and a plurality of grooves on an outer surface of a collet sleeve mounted to the mandrel.

18. The method of claim 17, wherein (c) comprises sliding the abutment surface of the release collet across the abutment surface of the second housing member to urge the tabs radially inward into engagement with the grooves.

19. The method of claim 14, further comprising (e) impacting an anvil surface in second housing member with a hammer surface of the mandrel.

* * * * *